US005883505A

United States Patent [19]

Magazzu'et al.

[11] Patent Number: 5,883,505

[45] Date of Patent: Mar. 16, 1999

[54] DRIVER CIRCUIT FOR MOS TRANSISTOR SWITCHES IN SWITCHING REGULATORS AND RELATED METHODS

[75] Inventors: Antonio Magazzu', Messina; Carmelo Settepani, Augusta; Alessandra Toscano, Catania, all of Italy

[73] Assignee: SGS-Thomson Microelectronics S.r.l., Agrate Brianza, Italy

[21] Appl. No.: 998,951

[22] Filed: Dec. 29, 1997

[51] Int. Cl.[6] ..... G05F 1/44

[52] U.S. Cl. ..... 323/282; 323/284

[58] Field of Search ..... 323/273, 274, 323/282, 284, 357

[56] References Cited

U.S. PATENT DOCUMENTS

| | | | |
|---|---|---|---|
| 4,007,415 | 2/1977 | Toyoda | 323/273 |
| 4,099,115 | 7/1978 | Watanabe | 323/314 |
| 4,103,218 | 7/1978 | Chevalier et al. | 323/217 |

*Primary Examiner*—Adolf Deneke Berhane

*Attorney, Agent, or Firm*—Allen, Dyer, Doppelt, Milbrath & Gilchrist, P.A.

[57] ABSTRACT

A driver circuit is for turning on at least one power MOS transistor having a diode connected thereto. The driver circuit preferably includes a smart driver circuit portion for increasing a drive current to the power MOS transistor responsive to turning on of the diode. The smart driver circuit may include a comparator having one input connected to the diode and a second input connected to a threshold signal indicative of the turning on of the diode. The smart driver circuit may also comprise: a first current source for supplying a first drive current; a second current source for supplying a second drive current; and a switch for connecting the second current source to the power MOS transistor responsive to the comparator. The smart driver circuit may further include a turn off circuit for turning off the increased drive current a predetermined time after turning on same, such as before turning off the first current. In addition, the second current source may supply a second drive current at least one order of magnitude larger that the first drive current. Of course, the driver circuit may be implemented with bipolar and MOS transistors Buck, boost, and buck-boost regulators may be implemented.

33 Claims, 3 Drawing Sheets

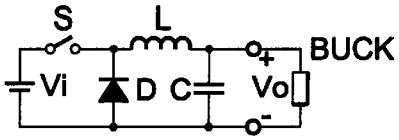
FIG. 1A.
(PRIOR ART)
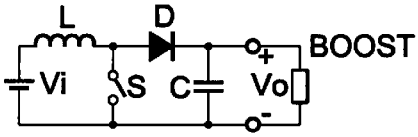
FIG. 1B.
(PRIOR ART)
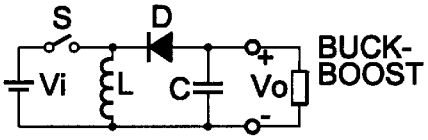
FIG. 1C.
(PRIOR ART)
FIG. 2A.
(PRIOR ART)
FIG. 2B.
(PRIOR ART)
FIG. 2C.
(PRIOR ART)
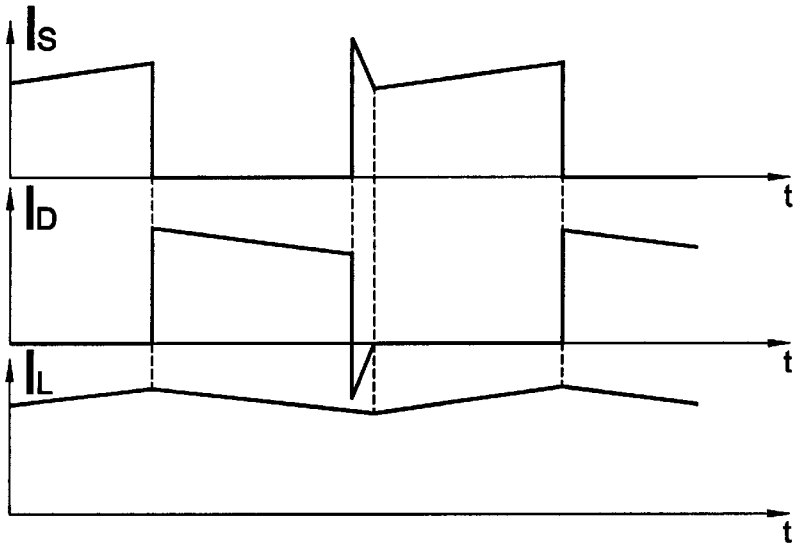
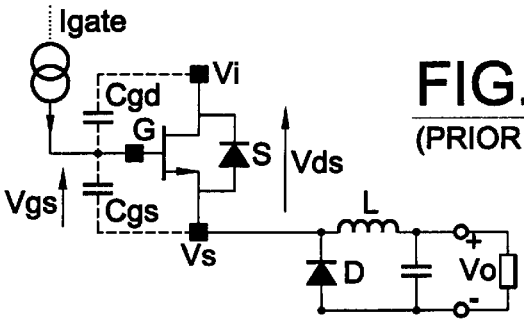
FIG. 3.
(PRIOR ART)

FIG. 4A.
(PRIOR ART)
FIG. 4B.
(PRIOR ART)
FIG. 4C.
(PRIOR ART)
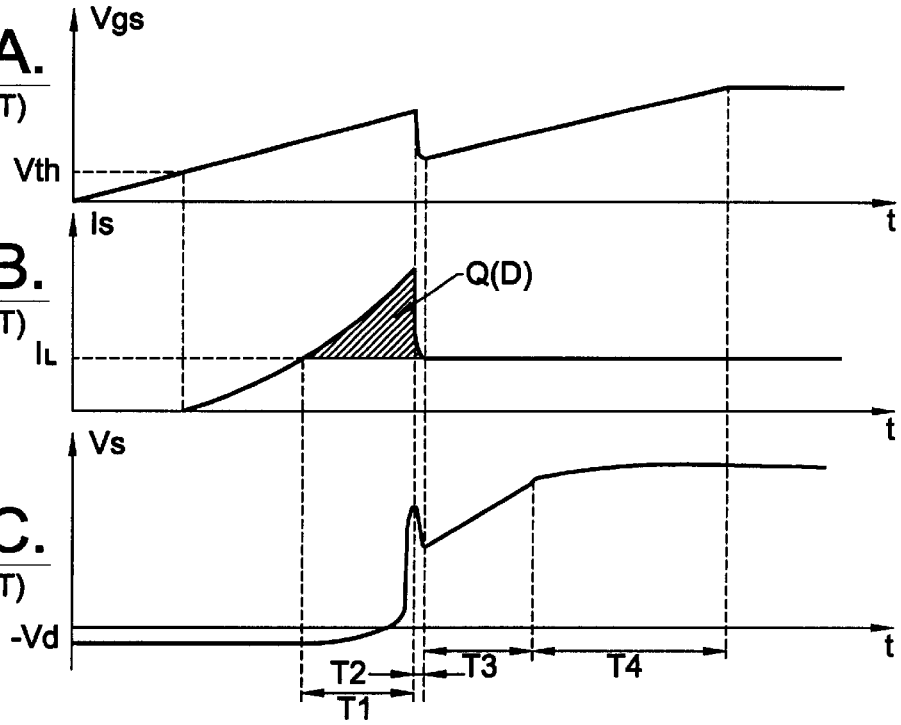
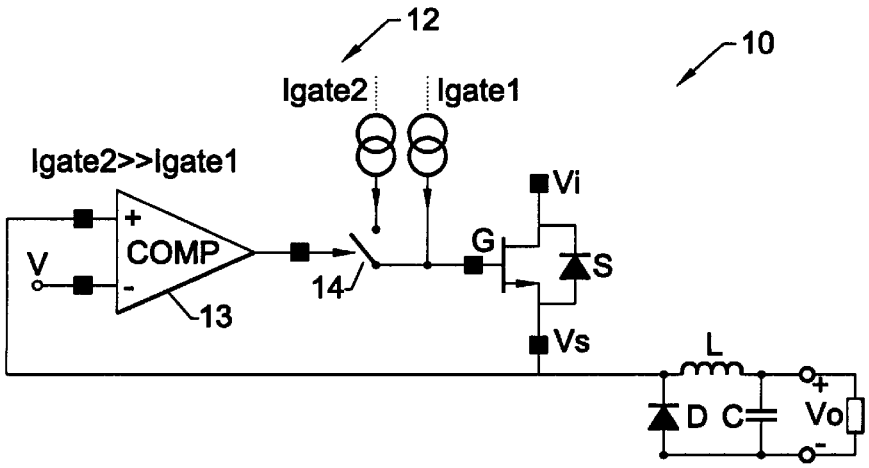
FIG. 5.

DRIVER CIRCUIT FOR MOS TRANSISTOR SWITCHES IN SWITCHING REGULATORS AND RELATED METHODS

BACKGROUND OF THE INVENTION

The present invention relates to the field of electronics, and, more particularly, to a driver circuit for transistor switches, such as may used in switching regulators

BACKGROUND OF THE INVENTION

Electronic voltage switching regulators are widely used in many applications to convert one DC voltage to another DC voltage, at least in part, because of their precision and performance efficiency. Such regulator circuits allow high efficiency compared with linear regulators, and while offering the same precision of output level.

A typical switching regulator includes a power switch, a feedback diode and an inductor coil. The continuing desire to reduce the integrated circuit area and the manufacturing costs encourages designers of regulator circuits to use smaller and smaller external components. Such regulator circuits also offer higher switching frequencies; however, the increasing switching frequencies limit the regulator efficiency. This is so because missed switchings may occur during the power switch transients. Accordingly, an important design aspect of a switching regulator relates to the driving portion of the regulator circuit, since the missed switchings and the stress on the switch itself and on feedback diode are due to the driver circuit.

The most common configurations of some switching regulator circuits are shown in FIGS. 1A, 1B and 1C. More specifically, the examples shown in the figures are for switching converters which are identified as: a buck converter (FIG. 1A), a boost converter (FIG. 1B), and a buck-boost converter (FIG. 1C), respectively.

The illustrated power switch S is typically a MOS transistor which is turned on and off by the driver circuit which acts on the transistor gate-source voltage. FIGS. 2A, 2B and 2C show schematic diagrams of current versus time of some current values flowing in the converters of FIGS. 1A, 1B and 1C.

FIG. 2A, for example, shows the peak of the switch current Is across the power switch during the turn on phase. Such a peak is caused by a reverse recovery time of the feedback diode D. In fact, the driver circuit forces the turn on of the transistor switch S by increasing its gate-source voltage. When this voltage overcomes the threshold value Vt of the transistor, the switch starts supplying the current Is.

If the diode D were ideal, such a diode would be turned off as soon as the current Is reaches the value of the current IL flowing through the inductor coil L, thereby avoiding the peak of the current Is. However, real diode components, for instance, Schottky diodes realized by P-N junctions, require discharging a certain charge quantity before turning off and this allows the current Is to increase until the diode drains the required charge. The required charge quantity depends on the reverse recovery time of the diode. In this situation, the gate-source voltage of the transistor switch continues to increase while the drain-gate voltage is relatively high. For instance, in a buck converter the drain-gate voltage equals the supply battery voltage Vi plus the diode voltage drop Vd. So, the switch S allows a high current to flow.

When the diode D is turned off, its capacitance decreases rapidly and the drain-source voltage of the transistor switch S arrives quickly at the saturation value. The corresponding current peak may be very dangerous for the circuit, since besides reducing the converter efficiency, it stresses the diode and the transistor switch thereby reducing their respective working lives. As a matter of fact, this current peak also produces electromagnetic disturbances which cause voltage swings on the supply voltage Vi because of the parasitic inductances caused by the metal conductors connected to the supply and to ground. These swings may cause the intervention of current limiter protection circuit portions which act on the transistor switch.

A previous attempt to address these difficulties generally included turning on the transistor switch relatively slowly, according to the quality of the feedback diode of the circuit. Unfortunately, this approach presents some drawbacks. For example, the driver circuit must be designed taking into account the recovery time of the feedback diode which is used, and this limits use to a predetermined kind of feedback diode. Even if a fast feedback diode is available, the charge current of the transistor switch S gate terminal cannot be very high and the gate-source voltage requires considerable time to reach the desired value. During this relatively long time, the switch resistance is higher than for the turn on value and the power loss increases thereby reducing the regulator circuit efficiency. The possible use of a relatively inexpensive diode would produce a slower switching rising edge with a further efficiency reduction.

A further drawback is present in known converters including a high side driver. Considering, for instance, the buck configuration shown in FIG. 1A, during the switch start up, the driver operates like a current generator furnishing the current value Igate, as shown in FIG. 3. The current generator charges the gate-source capacitance Cgs of the switch thereby increasing the gate-source voltage Vgs. When this voltage Vgs is greater than the transistor threshold voltage Vt, the MOS transistor star supplying a current. Therefore, the voltage potential on the power switch source terminal is −Vd until the current fed by the power switch S equals the current IL through the coil, as shown in FIGS, 4A, 4B and 4C.

When the transistor current overcomes the value of IL, the diode D operates as a short-circuit for the time necessary to drain the charge quantity which is required for turning off. The voltage on the transistor S source terminal increases very slowly. As soon as the diode D is turned off, its charge decreases quickly and the voltage value Vs increases very fast, such as a in few nanoseconds. The very short time interval T2, shown in FIG. 4C, represents the fast increase of Vs. The voltage drop Vgs decreases since the Vds reduction is equally due to the capacitance Cgd and Cgs.

To the Vgs reduction corresponds an increase of the internal resistance Rdson of the transistor switch and this delays for a time T3 the increase of the voltage Vgs thereby increasing dissipation. The further period T4 is required for the voltage Vgs to reach the desired value. During the third period T4, the resistance Rdson assumes a value greater than the operating regime value thereby also reducing the efficiency. The periods of time T3 and T4 depend on the current Igate, as well as the period T1.

SUMMARY OF THE INVENTION

In view of the foregoing background, it is an object of the present invention to provided a driver circuit for operating the transistor switch of a switching regulator at high efficiency and without stressing the power switch and/or feedback diode, and without generating undesirable electromagnetic interference.

This and other objects, features and advantages in accordance with the present invention are provided in one embodiment by a driver circuit for turning on at least one power MOS transistor having a diode connected thereto, and wherein the driver circuit comprises smart driver means for increasing a drive current to the power MOS transistor responsive to turning on of the diode. The smart driver means may include a comparator having one input connected to the diode and a second input connected to a threshold signal indicative of the turning on of the diode. The smart driver means may also comprise: a first current source for supplying a first drive current; a second current source for supplying a second drive current; and a switch for connecting the second current source to the power MOS transistor responsive to the comparator.

The smart driver means may further comprise turn off means for turning off the increased drive current a predetermined time after turning on same. More particularly, the turn off means may turn off the second current before turning off the first current. In addition, the second current source may supply a second drive current at least one order of magnitude larger that the first drive current Of course, the driver circuit may be implemented with bipolar and MOS transistors For a switching regulator of the buck or buck-boost type, the threshold signal may be about 2 or more volts greater than an on voltage of the diode. Along these lines, for a switching regulator of a boost type, the threshold signal may be about 3 or more volts lower than an on voltage of the diode.

A method aspect of the invention is for supplying a drive current for turning on at least one power MOS transistor having a diode connected thereto. The method preferably comprises the steps of: sensing a turning on of the diode, and increasing a drive current to the power MOS transistor responsive to turning on of the diode. The step of sensing preferably comprises comparing a signal at the diode to a threshold signal indicative of the turning on of the diode. In addition, the step of increasing preferably comprises the steps of: supplying a first drive current connected to the power MOS transistor; supplying a second drive current; and additionally connecting the second drive current to the power MOS transistor responsive to the comparing step.

In other words, the present invention increases the period T1 while reducing the other periods T3 and T4 as described above. In this manner, it is possible to set independently the switching rising edge period, the period of time for reaching the regime by Vgs, and the diode turning off period. The first two periods are reduced while the third period is optimized according to a compromise between efficiency and supply ringing disturbs. This eliminates the mutual dependence of the periods of time T1, T3 and T4, thereby increasing the performances and the efficiency of the power transistor switch. The inventive provides a smart driver circuit which recognizes the diode state and changes accordingly the gate drive current.

BRIEF DESCRIPTION OF THE DRAWINGS

These and other features and advantages of the regulator and driver circuit, according to the invention, will be appreciated by the following description of a preferred embodiment given by way of non-limiting example with reference to the annexed drawings in which:

FIGS. 1A, 1B and 1C are simplified schematic diagrams of switching regulator circuits as in the prior art;

FIGS. 2A, 2B and 2C are schematic timing diagrams of current signals for the switch, diode, and inductor coil of the regulator circuits of FIGS. 1A, 1B and 1C, respectively;

FIG. 3 is a schematic diagram of a buck converter according to the prior art;

FIGS. 4A, 4B and 4C are schematic timing diagrams of gate-source voltage of the switch, the current through the inductor coil, and the source voltage, respectively, for the converter of FIG. 3;

FIG. 5 is a simplified schematic diagram of driver circuit according to the present invention.

DETAILED DESCRIPTION OF THE PREFERRED EMBODIMENTS

Figure 6:
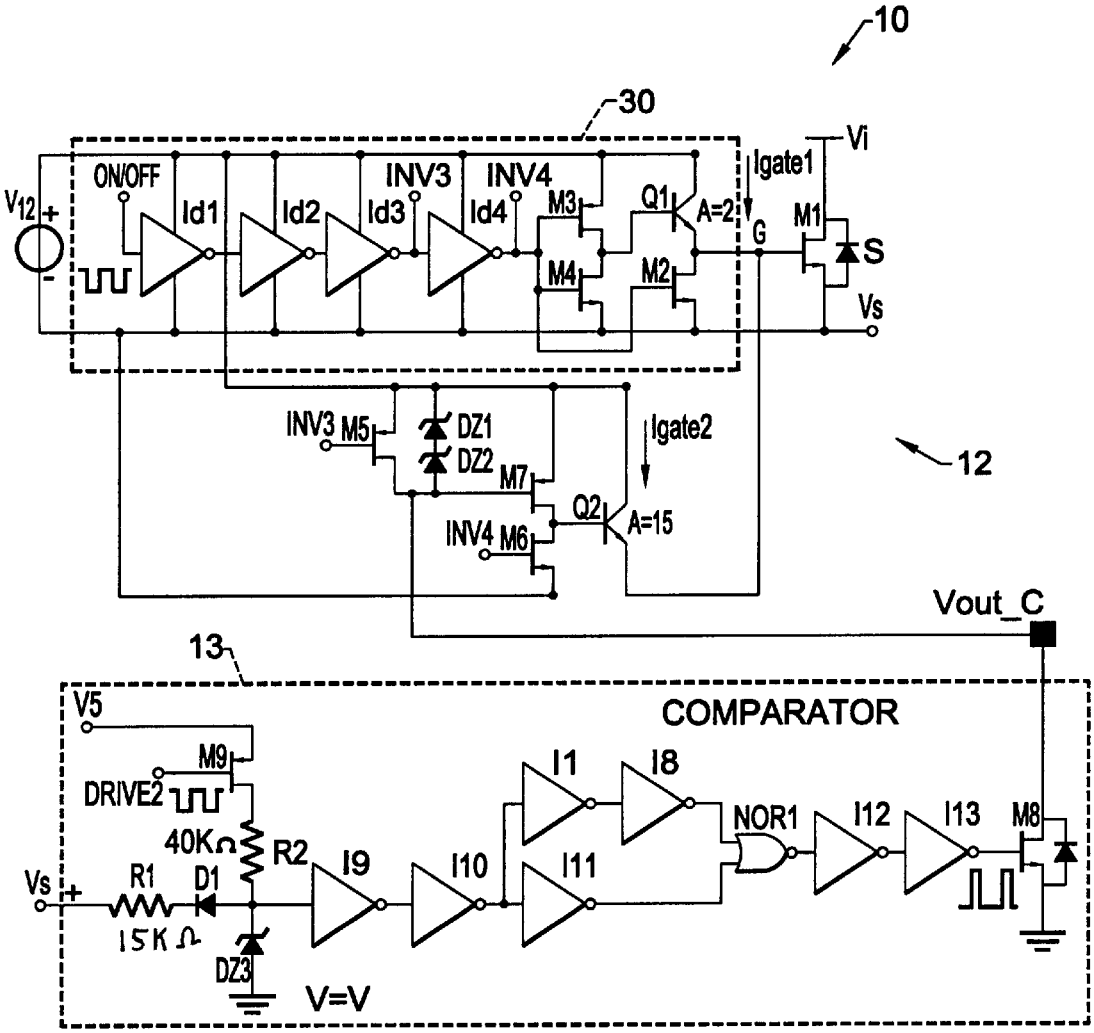
FIG. 6 is a more detailed schematic circuit of the driver circuit according to the present invention.

The present invention will now be described more fully hereinafter with reference to the accompanying drawings, in which preferred embodiments of the invention are shown This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring now to FIG. 5, a buck DC-to-DC converter or switching regulator 10 including a high side driver circuit 12 in accordance with the present invention is first described. The driver circuit 12 is for the illustrated MOS transistor switch S which may be used in the buck regulator 10, or in other types of regulators, as will be readily appreciated by those skilled in the art. The MOS transistor S in the illustrated embodiment is a power NMOS transistor having a gate terminal and source and drain terminals. The drain terminal is illustratively connected to a supply reference Vi. The diode D, inductor coil L, and capacitor C have been described above, and need no further description. The regulator 10 produces the desired output voltage Vo as will also be appreciated by those skilled in the art, The driver circuit 12 is illustratively used as the high side driver and includes a comparator 13 having an inverting input (−) and a non-inverting input (+). The inverting input receives a threshold voltage signal Vthresh while the other noninverting input is feedback connected to the source terminal of the power transistor S. A first current generator Igate1 is connected to feed the gate terminal of the transistor S. Moreover, a second current generator Igate2 is connected to selectively feed the gate terminal of the transistor S through operation of a switch 14 driven by the output of the comparator 13. The second current generator produces a current Igate2 which is much higher than the current Igate1 produced by the first current generator.

The driver circuit 12 operates its control function by monitoring the voltage Vs on the common node shared by the diode D, the inductor L and the transistor switch S, and by varying the driving current when the voltage Vs changes quickly during the period of time T2 (FIGS. 4A–4C). The quick variation of Vs may be easily implemented in all the different switching configurations: buck, boost and buck-boost as will be readily understood by those skilled in the art.

The comparator 12 is provided with a suitable threshold Vthresh input which is set to recognize the diode D turning off instant. For example, such a threshold may be set 2 or 3 V higher than the voltage Vs on the node when the diode D is on for the buck and the buck-boost configurations; or 2 or 3 V lower for the boost configuration. The comparator 12 need not be very precise; however, it is preferred that the comparator be relatively fast so that the circuit may respond quickly so that the driving current may rise within a few nanoseconds.

The smart driving function which is shown in FIG. 5 may be applied to all the switching configurations which may also include a PMOS power transistor as a switch as will also be readily understood by those skilled in the art without further description herein.

It may be preferable to activate the second current generator Igate2 just for a short period of time, for instance for constant time, in order to maintain a good turning off falling edge. In other words, the second current generator Igate2 may be turned off before the first current generator Igate1 is turned off. Many timing circuits are contemplated by the present invention for performing such switching as will be readily appreciated by those skilled in the art.

Turning now additionally to FIG. 6, further details of an embodiment of the invention is now described as may be implemented using BiCMOS technology, such as designated BCD60II technology by the assignee of the present invention. In FIG. 6, the power switch is identified by M1 and is a vertical N-channel DMOS device which may work at voltages under 60 V. The reference voltage Vin may vary within the range of about 8 V to 55 V.

A voltage generator V12 may be provided by a boostrap capacitor which allows the supply voltage of the driver circuit to be constant and independent of the voltage value on the source terminal of the power switch M1 as will be readily understood by those skilled in the art. Four inverters Id1, . . . , Id4 are illustratively used to produce the desired ON/OFF signal.

A transistor M2 is connected to the gate terminal of the power MOS transistor M1 and acts on the transistor M1 for turning it off. The transistor M2 h/may have a width of about 5000 $\mu$m, and a length of about 7 $\mu$m. The first current source Igate1 is fed by a first npn bipolar transistor Q1 which amplifies the current crossing the transistor M3 and the value of which may be about few milliamperes. Transistor M3, for example, may have a width of about 40 $\mu$m and a length of about 7 $\mu$m. Transistor M4 which is connected to transistor M3 may have a width of about 176 $\mu$m and a length of about 7 $\mu$m, for example. The upper circuit portion 30 which is delimited by the dotted line may be considered a conventional driver circuit as will be readily understood by those skilled in the art.

During the OFF phase, the signals INV3 and INV4 are at a low and a high logic level, respectively, and the transistor Q2 is off. During the first ON phase, the transistor Q1 is on and supplies a current which raises the voltage value on the gate terminal of the power MOS transistor M1. The signals INV3 and INV4 invert their logic values, but the transistor Q2 remains off since transistor M8 is off and the gate terminal of transistor M7 is still high. Transistor M7 may have a width of about 250 $\mu$m and a length of about 7 $\mu$m, and transistor M6 may have a width of about 100 $\mu$m and a length of about 7 $\mu$m, for example. Transistor M5 which is has a gate receiving the signal INV3, may have a width of about 50 $\mu$m and a length of about 7 $\mu$m, for example.

The signal DRIVE2 is low when the input signal is ON. The internal resistance of the transistor M9 is very small compared with the 40 kΩ value of the resistor R2. During the initial start up phase, the source terminal of the power transistor M1 present a potential Vs which is still low. Therefore, the diode D1 is on. The input voltage of the inverter I9 is low too. The resistors R1 and R2 are dimensioned so that the input voltage of the inverter I9 will be quite close to its threshold. The resistor R1 may have a value of about 15 kΩ, for example. When the external feedback diode is turned off, the voltage Vs increases quickly and forces the inverter I9 to switch.

The eight inverters I1, . . . , I8 have been dimensioned so that the NOR1 gate receives as its logic input two "zeros" for at least 100 nanoseconds. During this brief period of time, the gate of transistor M8 goes high turning on the transistor M7 which starts feeding a current. Such a current is amplified by the bipolar transistor Q2 which raises the potential on the gate of transistor M1. At the end of the 100 nanosecond period, the gate of transistor M8 returns to a low logic level. The usual propagation time for the feedback diode turning off command, allowing transistor Q2 to turn on, is less than 10 nanoseconds.

The two resistors R1, R2, and the transistor M9 are preferably integrated into the inventive circuit 10 to speed up the switching of the inverter I9 The diodes D1 and DZ3 are used to avoid a breakdown of the logic gate I9 and a current consumption through resistor R1 during the on phases of transistor M1.

The zener diodes DZ1, DZ2 are used to protect the gate of transistor M7 during the turn on phase of transistor M8. The logic gates Id1, . . . , Id4 and the transistors M1, . . . , M7 are preferably implemented in CMOS 12 V technology inside 70 V wells. The transistor M8 may be a vertical DMOS power transistor working within 80 V as will be readily appreciated by those skilled in the art.

The current which may be supplied through transistor Q2, for examples is preferably one order of magnitude greater than the current supplied through Q1 The low value of the Igate1 current allows the use of a relatively inexpensive feedback diode without reducing the circuit efficiency and without compromising the correct operation of the converter 10. The diode D (FIG. 5) is not stressed and the power transistor switch M1 has a low radiation of electromagnetic disturbances or interference. The high value of the Igate2 current allows maximization of the converter efficiency by using high quality diodes.

The driver circuit in accordance with the present invention may have applicability to other circuits which include at least one power MOS transistor and a feedback diode connected thereto Accordingly, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A switching regulator comprising:

at least one power MOS transistor having a gate, source and drain terminals;

a diode connected to the source terminal of said at least one power MOS transistor; and a driver connected to the gate and source terminals of said at least one power MOS transistor for supplying a drive current to turn on said at least one power MOS transistor to thereby maintain a desired output level of the switching regulator;

said driver comprising smart driver means for altering the drive current to said at least one power MOS transistor responsive to a state of said diode and for changing the voltage between the gate and source terminals of the power MOS transistor between zero volts and a maximum voltage for every switching cycle.

2. A switching regulator according to claim 1 wherein said smart driver means comprises means for sensing turning on of said diode, and for increasing the drive current responsive thereto.

3. A switching regulator according to claim 1 wherein said smart driver means further comprises turn off means for turning off the increased drive current a predetermined time after turning on same.

4. A switching regulator according to claim 1 wherein said smart driver means comprises a comparator having one input connected to said diode and a second input connected to a threshold signal indicative of the turning on of said diode.

5. A switching regulator according to claim 4 wherein said regulator is one of a buck or buck-boost type; and wherein the threshold signal is about 2 or more volts greater than an on voltage of said diode.

6. A switching regulator according to claim 4 wherein said regulator is a boost type; and wherein the threshold signal is about 3 or more volts lower than an on voltage of said diode.

7. A switching regulator according to claim 4 wherein the first input of said comparator is a non-inverting input and the second input is an inverting input.

8. A switching regulator according to claim 4 wherein said smart driver means comprises:

a first current source for supplying a first drive current;

a second current source for supplying a second drive current greater than the first drive current; and a switch for connecting the second current source to the at least one power MOS transistor responsive to said comparator.

9. A switching regulator according to claim 8 wherein said second current source supplies the second drive current to be at least one order of magnitude larger that the first drive current.

10. A switching regulator according to claim 8 wherein said smart driver means further comprises means for turning off the second current source before turning off the first current source.

11. A switching regulator according to claim 4 wherein said comparator comprises a plurality of invertors connected in series.

12. A switching regulator according to claim 1 wherein said driver comprises bipolar and MOS transistors.

13. A switching regulator comprising:

at least one power MOS transistor;

a diode connected to said at least one power MOS transistor; and a driver connected to said at least one power MOS transistor for supplying a drive current to turn on said at least one power MOS transistor to thereby maintain a desired output level of the switching regulator, said driver comprising a comparator having one input connected to said diode and a second input connected to a threshold signal indicative of the turning on of said diode, a first current source for supplying a first drive currents a second current source for supplying a second drive current, and a switch for connecting the second current source to the at least one power MOS transistor responsive to said comparator to thereby increase the drive current responsive to turning on of said voltage.

14. A switching regulator according to claim 13 wherein said driver further comprises turn off means for turning off the second drive current a predetermined time after turning on same.

15. A switching regulator according to claim 14 wherein said turn off means comprises means for turning off the second current source before turning off the first current source.

16. A switching regulator according to claim 13 wherein said regulator is one of a buck or buck-boost type; and wherein the threshold signal is about 2 or more volts greater than an on voltage of said diode.

17. A switching regulator according to claim 13 wherein said regulator is a boost type; and wherein the threshold signal is about 3 or more volts lower than an on voltage of said diode.

18. A switching regulator according to claim 13 wherein the first input of said comparator is a non-inverting input and the second input is an inverting input.

19. A switching regulator according to claim 13 wherein said second current source supplies the second drive current to be greater than the first drive current.

20. A switching regulator according to claim 13 wherein said second current source supplies the second drive current to be at least one order of magnitude larger that the first drive current.

21. A switching regulator according to claim 13 wherein said comparator comprises a plurality of invertors connected in series.

22. A switching regulator according to claim 13 wherein said driver comprises bipolar and MOS transistors.

23. A driver circuit for turning on at least one power MOS transistor having a diode connected thereto and a gate-source voltage, said driver circuit comprising:

smart driver means for increasing a drive current to the at least one power MOS transistor responsive to turning on of the diode;

said smart driver means comprising a comparator having one input connected to the diode and a second input connected to a threshold signal indicative of the turning on of the diode and wherein said smart driver means changes the gate-source voltage of the at least one power MOS transistor between zero volts and a maximum voltage for every switching cycle.

24. A driver circuit according to claim 23 wherein said smart driver means further comprises:

a first current source for supplying a first drive current;

a second current source for supplying a second drive current; and a switch for connecting the second current source to the at least one power MOS transistor responsive to said comparator.

25. A driver circuit according to claim 24 wherein said smart driver means further comprises turn off means for turning off the increased drive current a predetermined time after turning on same.

26. A driver circuit according to claim 23 wherein the first input of said comparator is a non-inverting input and the second input is an inverting input.

27. A driver circuit according to claim 23 wherein said second current source supplies a second drive current at least one order of magnitude larger that the first drive current.

28. A driver circuit according to claim 23 wherein said smart driver means comprises bipolar and MOS transistors.

29. A method for supplying a drive current for turning on at least one power MOS transistor having a gate-source voltage and a diode connected thereto, the method comprising the steps of:

sensing a turning on of the diode; and increasing a drive current to the at least one power MOS transistor responsive to turning on of the diode; and changing the gate-source voltage between zero volts and a maximum voltage every switching cycle.

30. A method according to claim 29 wherein the step of sensing comprises comparing a signal at the diode to a threshold signal indicative of the turning on of the diode.

31. A method according to claim 30 wherein the step of increasing comprises the steps of:

supplying a first drive current connected to the at least one power MOS transistor;

supplying a second drive current; and additionally connecting the second drive current to the at least one power MOS transistor responsive to the comparing step.

32. A method according to claim 29 further comprising the step of turning off the increased drive current a predetermined time after turning on same.

33. A method according to claim 31 wherein the step of supplying the second drive current comprises supplying same to be at least one order of magnitude larger that the first drive current.

* * * * *